United States Patent [19]

Getchell

[11] 4,043,492

[45] Aug. 23, 1977

[54] DRAPERY PRESSING APPARATUS

[76] Inventor: F. Grant Getchell, 510 Antelope Way, Eugene, Oreg. 97401

[21] Appl. No.: 736,748

[22] Filed: Nov. 18, 1976

[51] Int. Cl.[2] ..... A41H 43/00

[52] U.S. Cl. ..... 223/30

[58] Field of Search ..... 223/28–35

[56] References Cited

U.S. PATENT DOCUMENTS

| | | | |
|---|---|---|---|
| 2,850,218 | 9/1958 | Gibson et al. | 223/30 |
| 3,824,964 | 7/1974 | Ryan | 223/30 |

*Primary Examiner*—G. V. Larkin

*Attorney, Agent, or Firm*—James D. Givnan, Jr.

[57] ABSTRACT

An apparatus having cooperating upright structures each having a series of air carrying tubes acting on opposite sides of a drapery to press same into desired folds. The two series of tubes and upright structures are adapted for opening and closing movement during a pressing cycle. Ducting admits a pressurized airflow and steam into communicating ducts of the upright structures for dispersal by the air tubes. Some of said air tubes are covered with fabric jackets which inflate during a pressing operation.

14 Claims, 4 Drawing Figures

DRAPERY PRESSING APPARATUS

BACKGROUND OF THE INVENTION

The present invention relates generally to equipment for pressing draperies by the application of air and steam thereto.

The pressing of draperies in cleaning and pressing establishments normally entails lengthy and tedious handling of each drapery. The considerable size and pliable nature of draperies renders same extremely awkward to handle. The large size of most draperies requires that they each be manually introduced and removed from pressing equipment by a worker or workers with considerable time being devoted to each drapery processed. The labor expense encountered by existing pressing equipment results in a high per drapery pressing cost.

SUMMARY OF THE PRESENT INVENTION

The present invention is embodied within an apparatus for processing draperies while the drapery is suspended and includes a movable series of pressing tubes cooperating with a second series of perforate tubes to impart physical pressure and a fluid flow, such as steam or air or a combination thereof, to the drapery surfaces.

The apparatus includes a movable support on which is mounted a series of tubular structures which move into intimate contact with the drapery and displace same into like contact with a second series of tubular members which may be stationary. Upright support structures define air passageways which receive a pressurized flow of air and distribute the flow into each of the tubular structures supported thereon. The stationary structure for one series of tubular structures also defines a chamber receiving and distributing a pressurized flow of air (or steam). The support structures are adapted for opening and closing movement relative to one another and to a drapery therebetween. A track supports a curtain carrying trolley which enables a worker to conveniently pull the curtain into place between the upright structures and, subsequently, remove the suspended drapery after completion of the finishing operation. Controls are provided regulating a flow of pressurized air and steam into the series of tubular structures as well as to control movement of a positionable tube support structure.

Important objectives of the present apparatus include the provision of an apparatus for pressing draperies while the latter are suspended in their normal hanging state and accordingly avoids the tedious manual operations of loading and removing the draperies from existing pressing equipment; an additional objective of the present apparatus is the pressing of draperies into the gently folded serpentine state desired whereby the drapery is finished for immediate hanging in the home or building; an additional objective is the provision of an apparatus having communicating duct structures which close into communication with one another during a pressing operation to supply tubular air members with a source of pressurized air and/or steam; the provision of an apparatus whereby a single operator may press a large number of rail supported draperies within a working shift to substantially lower per drapery pressing costs to the plant operator. These and other objectives will become subsequently apparent upon an understanding of the following description.

BRIEF DESCRIPTION OF THE DRAWINGS

In the accompanying drawings:

FIG. 3 is an elevational view of the back side of a movable air tube support structure; and FIG. 4 is an enlarged elevational view of duct structure with outlets and air tubes attached thereto.

DETAILED DESCRIPTION OF THE PREFERRED EMBODIMENT

Figure 1:
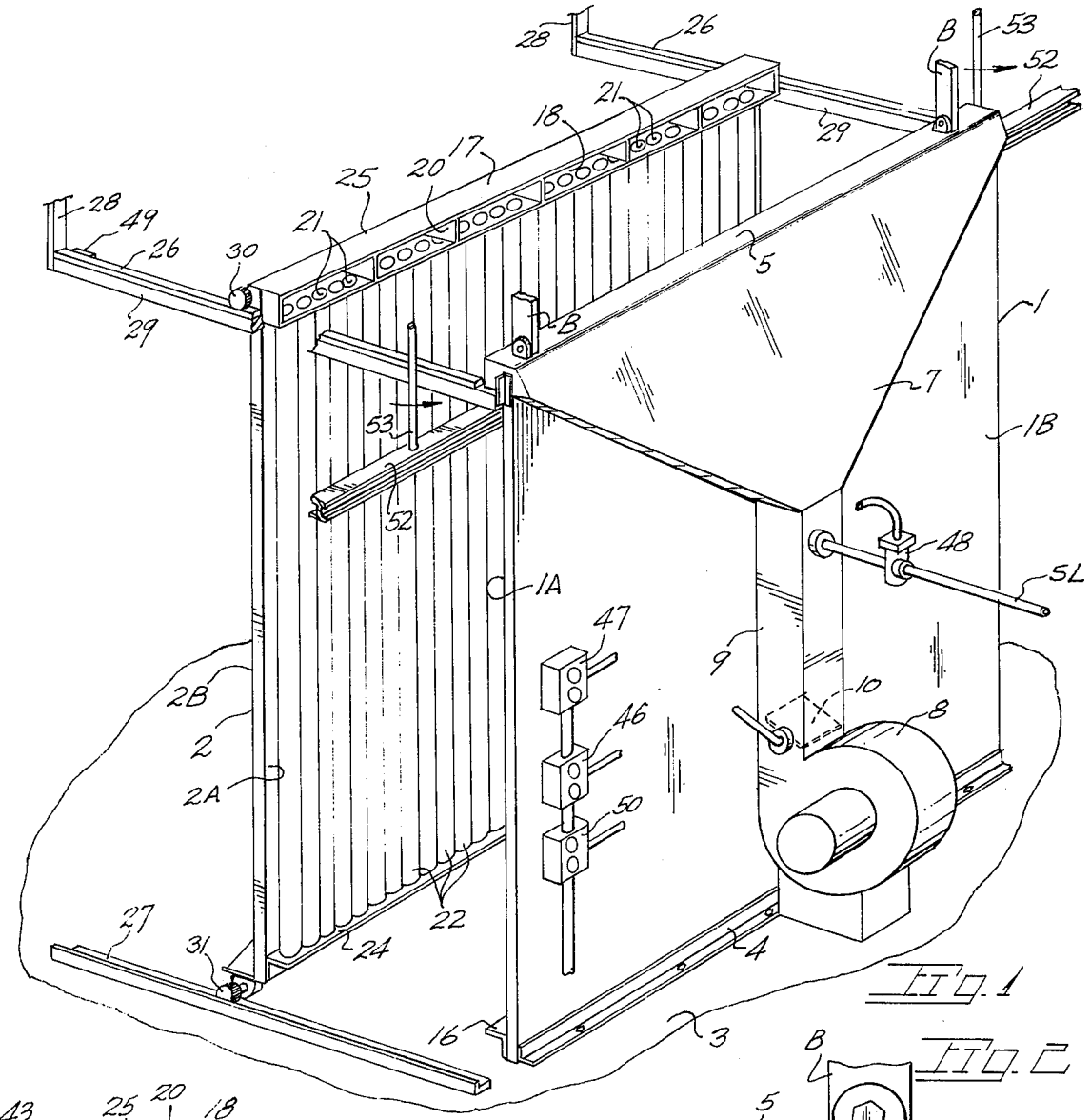
FIG. 1 is a perspective view of the present apparatus in an open, drapery receiving configuration.

With continuing reference to the accompanying drawing wherein applied reference numerals indicate parts similarly identified in the following specification, reference numeral 1 indicates a stationary tube supporting structure while a movable tube supporting structure is indicated at 2.

The upright support structures are, generally speaking, of internally braced, panel construction having inner and outer planar surfaces at 1A–1B; 2A–2B. Support structure 1 is fixed in place on a floor surface 3 as by an angle member 4 for serving to secure the lower end of the support structure. Braces at B secure the upper end of support structure 1. Secured in place across the top of support structure 1 is a transverse duct 5 defining a chamber 6 which receives a pressurized flow of air (or steam, or steam and air) from a dispersal duct 7 which in turn receives an air flow from a blower fan 8 via a duct 9. Control means are provided at 10 for airflow regulation. Dispersal duct 7 provides a uniform flow of air into chamber 6 of duct 5.

Figure 2:
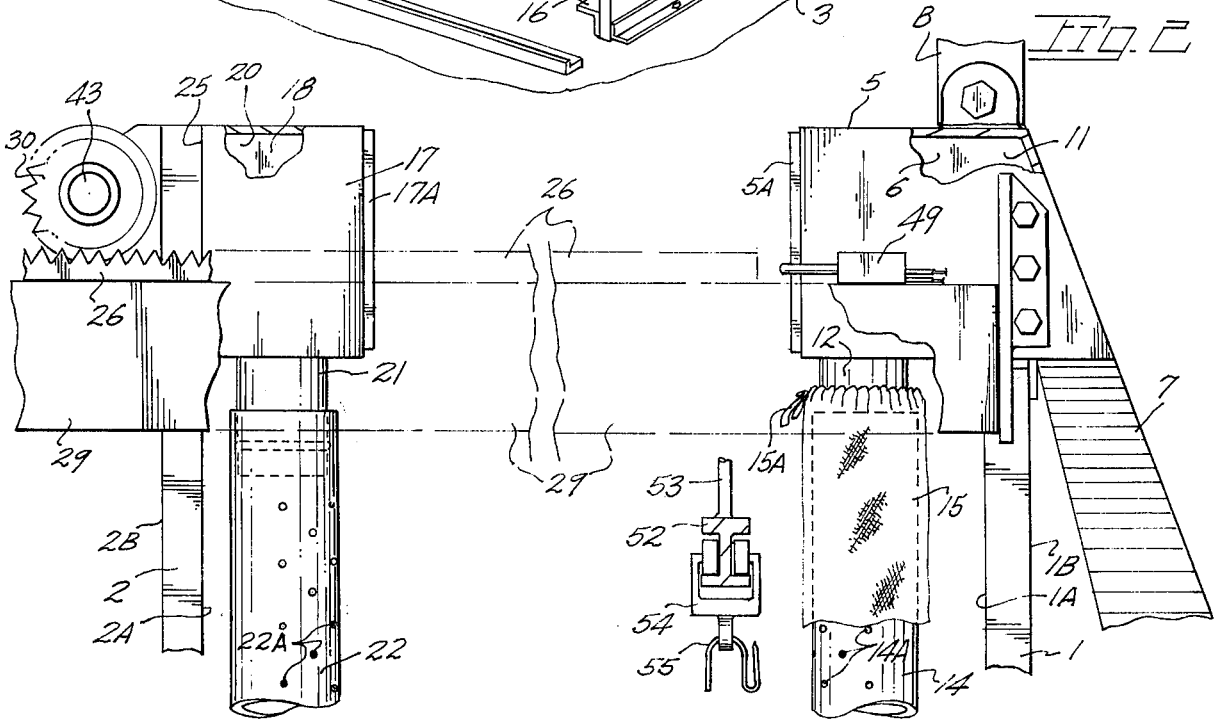
FIG. 2 is a fragmentary side elevational view of the uppermost portions of the upright air tube support structures in an open drapery receiving position.
Figure 1:
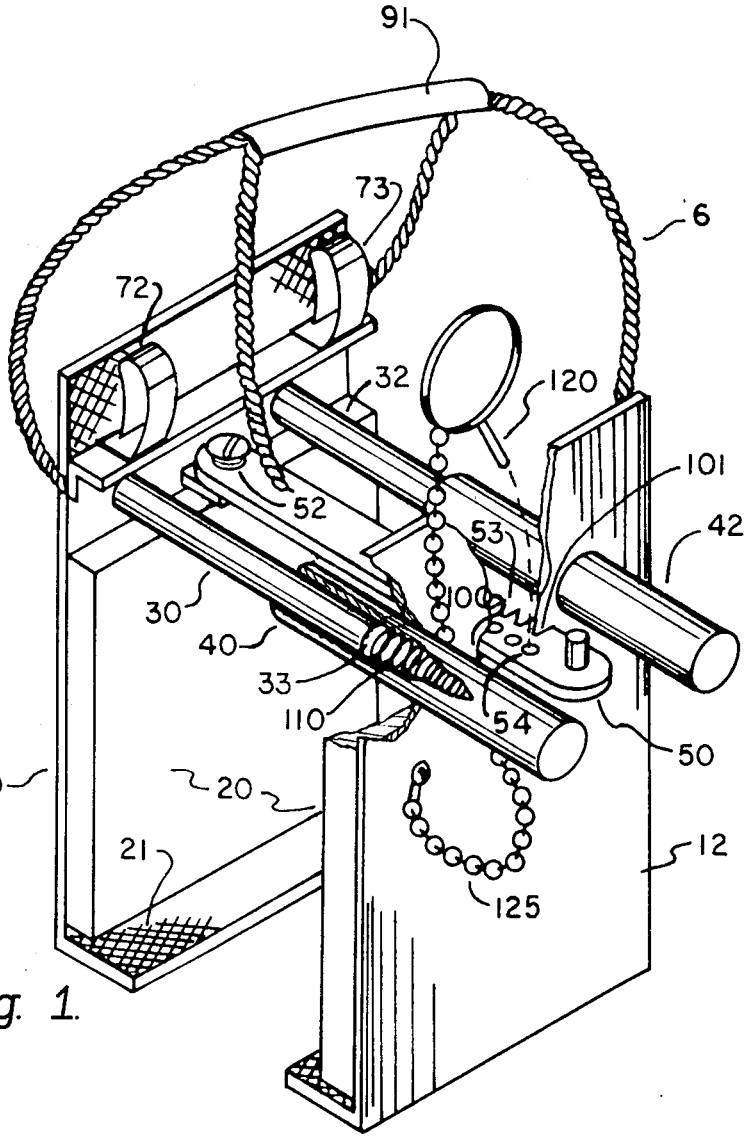

With attention now to FIGS. 2 and 4, the fragment of chamber 6 shown therein is provided with spaced apart baffles at 11 which confine the air for downward passage into chamber outlets 12 for subsequent discharge into a first series of air tube structures each comprising a rigid tubular member 14 in endwise communication with an outlet 12 with a porous fabric sheath 15 overlying the length of the tubular member and secured as by a tie 15A about its upper end. Tubular member 14 is perforate with openings 14A spaced therealong for the outward discharge of pressurized air towards a drapery. The bottom end of each tube 14 is closed and suitably secured in place on a support 16 (FIG. 1). Fabric sheath 15 is preferably of a woven synthetic fiber.

With attention now to movable support structure 2, the upper end of same is provided with an elongate duct 17 defining a chamber 18, partitions 20 spaced thereacross. Outlets at 21 are in the form of collars to which are applied tubular members 22 all as earlier described in connection with stationary structure 1. The lower end of each tubular member 22 is closed and rests on a support 24. Desirably the tube ends and the outlets 21 are in sealed engagement as by an intermediate O-ring. No fabric sheaths are used on the tubular series in place on movable support structure 2. Again, each tube 22 is apertured at 22A along its outer surface for air dispersal toward the adjacent drapery.

With attention to transverse ducts 5 and 17, the same are each defined by top, bottom and end wall members with duct 17 additionally defined by a back wall 25. Each duct is suitably secured atop its respective upright structure and includes a resilient strip 5A, 17A to affect a seal when in abutment with one another. Duct 5 of the stationary unit 1 is, as earlier noted, in open communication with dispersal duct 7.

To provide for opening and closing movement of upright support structure 2 the same is rail supported by pairs of upper and lower gear racks indicated at 26 and 27. Upper racks 26 are secured in place on beams 29 affixed at their ends to support structure 1 and to a pair of braces at 28. Lower racks 27 are secured to floor 3. To assure uniform movement of upright structure 2, rail engaging upper and lower pinions at 30 and 31 are in toothed engagement with their respective racks.

A drive motor at 33 (FIG. 3) on support structure 2 is in driving engagement with upper and lower pinions 30 and 31 by a right angle reduction drive 34, output shaft 35, sprockets 36–37 and roller chains 38–39 which, in turn, drive sprockets 40 and 41 affixed to pinion carrying shafts 42–43. Pillow block bearings at 44 and 45 carry the shafts. Motor 33 is reversible to power support structure 2 toward and away from support structure 1. A motor control is indicated at 46 on stationary support 1. Limit switches as at 49 limit motor operation. A switch 47 on structure 1 at an operator's station is in circuit with a solenoid valve 48 in a steam line SL to permit operator control of steam flow into the airflow of duct 9 and ultimately to the draperies. Indicated at 50 at the operator's station is a blower switch for controlling motor operation of blower 8.

Draperies are manually drawn through the apparatus while suspended from a track 52 which is yieldably mounted by means of hangers at 53. The upper ends of said hangers may swing about horizontal pivots to provide a limited degree of drapery displacement during a pressing operation whereby the drapery is uniformly acted upon by the two series of tubular pressing components. Trolleys at 54 traverse the rail 52 with each serving to receive a drapery hook 55.

In operation, the drapery is suspended from trolley 53 and moved into position between the support structures 1 and 2 whereupon the structures are closed by actuation of motor control 46. Limit switch 49 (FIG. 2) serves to open the motor circuit to stop the advancement of support structure 2 in duct abutment against structure 1 with the two series of air tubes biasing opposite sides of the drapery. The operator closes a switch at 50 to energize blower fan 8, steam being injected via solenoid valve 48. The draperies are accordingly pressed for the desired duration, whereupon the air and steam are terminated prior to opening of the structures 1 and 2 for drapery removal.

While I have shown but one embodiment of the invention it will be apparent to those skilled in the art that the invention may be embodied still otherwise without departing from the spirit and scope of the claimed invention.

Having thus described the invention what is desired to be secured under a Letters Patent is:

1. An apparatus for pressing draperies and the like, said apparatus comprising, upright structures each supporting a series of vertically disposed tubular pressing components, at least one of said structures adapted for movement toward and away from the remaining structure, said upright structures defining communicating ducts, means supporting said one upright structure for opening and closing movement relative to the remaining structure, motor means driving said one structure toward and away from the remaining structure, and said series of tubular pressing components adapted to bias opposite surfaces of the drapery in a staggered manner to press same in serpentine folds.

2. The apparatus claimed in claim 1 wherein said pressing components are perforate with some of said components including a fabric sheath to enhance pressing of the draperies.

3. The apparatus claimed in claim 1 additionally including a track disposed intermediate said upright structure on which draperies are conveyed into and out of the apparatus.

4. The apparatus claimed in claim 1 wherein said supporting means comprise upper and lower pairs of rails and pinions in toothed engagement therewith.

5. The apparatus claimed in claim 1 additionally including a source of pressurized air and steam in valve controlled communication with one of said support structures.

6. The apparatus claimed in claim 1 wherein said communicating ducts are each disposed transversely of their respective upright structure.

7. The apparatus claimed in claim 6 wherein at least one of said elongate ducts is provided with a resilient member serving as a duct seal when the ducts are in communicating abutment.

8. The apparatus claimed in claim 6 wherein one of said support structures additionally includes a dispersal duct in communication with the elongate duct thereon.

9. In a pressing apparatus for treating fabric, the improvement comprising, first and second series of upright tubular pressing components, upright structures supporting each of said series, with at least one of said structures adapted for movement toward and away from a remaining upright structure, and dispersal means associated with each of said upright structures receiving a pressurized airflow and directing same into the ends of said tubular pressing components.

10. The apparatus claimed in claim 9 wherein some of said tubular components include a porous sheath.

11. The apparatus claimed in claim 9 wherein said dispersal means comprises ducts carried by said upright structures, said ducts adapted for communicating registration with one another.

12. The apparatus claimed in claim 11 wherein said ducts are each disposed transversely of their respective upright structure with at least one of said ducts being provided with a resilient member serving as a duct seal when the ducts are in communicating registration.

13. The apparatus claimed in claim 9 wherein at least one of said upright structures includes a dispersal duct in down-stream communication with one of the first mentioned ducts.

14. The apparatus claimed in claim 9 additional including a track disposed between said upright structure on which articles to be treated are conveyed.

* * * * *